US010336486B2

(12) United States Patent
Luo

(10) Patent No.: US 10,336,486 B2
(45) Date of Patent: Jul. 2, 2019

(54) MACHINE CORE OF A PACKING MACHINE

(71) Applicant: HANGZHOU YOUNGSUN INTELLIGENT EQUIPMENT CO., LTD., Xihu Hangzhou, Zhejiang (CN)

(72) Inventor: Bangyi Luo, Xihu Hangzhou, Zhejiang (CN)

(73) Assignee: Hangzhou Youngsun Intelligent Equipment Co., Ltd., Hangzhou, Zhejiang Province (CN)

( * ) Notice: Subject to any disclaimer, the term of this patent is extended or adjusted under 35 U.S.C. 154(b) by 988 days.

(21) Appl. No.: 14/768,643

(22) PCT Filed: Mar. 12, 2013

(86) PCT No.: PCT/CN2013/072430
§ 371 (c)(1),
(2) Date: Aug. 18, 2015

(87) PCT Pub. No.: WO2014/127550
PCT Pub. Date: Aug. 28, 2014

(65) Prior Publication Data

US 2016/0001902 A1 Jan. 7, 2016

(30) Foreign Application Priority Data

Feb. 21, 2013 (CN) ..... 2013 1 0055238
Feb. 21, 2013 (CN) ..... 2013 2 0079940 U

(51) Int. Cl.
*B65B 65/02* (2006.01)
*B65B 13/22* (2006.01)
(Continued)

(52) U.S. Cl.
CPC ..... *B65B 13/22* (2013.01); *B65B 13/18* (2013.01); *B65B 13/187* (2013.01); *B65B 13/32* (2013.01); *B65B 65/02* (2013.01)

(58) Field of Classification Search
CPC ..... B65B 13/22; B65B 13/18; B65B 13/32; B65B 65/02; B65B 13/187
(Continued)

(56) References Cited

U.S. PATENT DOCUMENTS 3,804,001 A * 4/1974 Longerich ..... B65B 27/12 100/4
6,155,032 A * 12/2000 Lai ..... B65B 13/22 100/29
(Continued)

FOREIGN PATENT DOCUMENTS

CN 201189961 Y 2/2000
CN 201777399 U 3/2011
(Continued)

*Primary Examiner* — Jimmy T Nguyen
(74) *Attorney, Agent, or Firm* — Muncy, Geissler, Olds & Lowe, P.C.

(57) ABSTRACT

A machine core of a packing machine includes a packing strap ironing adhering and strap cutting mechanism, an ironing adhering sliding board mechanism, and a control mechanism. The machine core includes a strap feeding and returning and strap tightening device, including a drive roller, a first driven roller, and a second driven roller. According to the entry direction of a packing strap, the first driven roller is located down-stream from the second driven roller. The first and the second driven rollers are arranged eccentrically. The first driven roller and the drive roller are always in contact and cooperate for feeding and returning the strap. The second driven roller is a movable roller, and is controlled by the control mechanism to move to a first matching state with the drive roller and to move out of the first matching state. The machine core enables movement of simultaneous strap returning and tightening.

7 Claims, 10 Drawing Sheets

(51) Int. Cl.
*B65B 13/32* (2006.01)
*B65B 13/18* (2006.01)

(58) Field of Classification Search
USPC ..... 100/29, 32
See application file for complete search history.

(56) References Cited

U.S. PATENT DOCUMENTS

| | | | | |
|---|---|---|---|---|
| 6,467,243 | B1 | 10/2002 | Su et al. | |
| 6,715,408 | B1 * | 4/2004 | Rossi | B65B 13/22 100/29 |
| 6,981,353 | B2 * | 1/2006 | Haberstroh | B65B 13/04 100/26 |
| 9,834,332 | B2 * | 12/2017 | Luo | B65B 13/22 |
| 2003/0221566 | A1 * | 12/2003 | Apel | B65B 13/185 100/29 |
| 2014/0298760 | A1 * | 10/2014 | Luo | B65B 13/00 53/588 |

FOREIGN PATENT DOCUMENTS

| | | | |
|---|---|---|---|
| CN | 201793033 | U | 4/2011 |
| CN | 202464229 | U | 10/2012 |

* cited by examiner

MACHINE CORE OF A PACKING MACHINE

TECHNICAL FIELD

The invention relates to a machine core of a packing machine.

BACKGROUND OF THE INVENTION

A packing machine is a device for strapping articles by packing straps, the whole packing process includes such steps as strap feeding, strap returning, tightening and ironing adhering, and these movements are mainly undertaken by the packing machine. A previous machine core is unstable in strapping force, complex in structure, uses gear engagement, a suction tube and an inductive switch to control tightening, and has more fault points.

SUMMARY OF THE INVENTION

The invention is intended to solve a technical problem by providing a machine core of a packing machine, which has a simple structure, reduced failure rate, and good packing. For this purpose, the invention adopts such a technical solution as below: the machine core of the packing machine includes a packing strap ironing adhering and strap cutting mechanism, an ironing adhering sliding board mechanism, and a control mechanism. The machine core is further provided with a strap feeding and returning and strap tightening device. The strap feeding and returning and strap tightening device includes a drive roller, a first driven roller, and a second driven roller. According to the entry direction of a packing strap, the first driven roller is located downstream from the second driven roller. The first driven roller and the second driven roller are respectively arranged eccentrically.

The first driven roller and the drive roller are always in contact with one another and cooperate for feeding and returning the strap. The second driven roller is a movable roller, and is controlled by the control mechanism to move to a first matching state with the drive roller and to move out of the first matching state with the drive roller. The first matching state is the state in which the second driven roller and the drive roller are in contact with and cooperating with one another for tightening the strap.

On the basis of adoption of the technical solution mentioned above, the invention also may further adopt such a technical solution as below.

Between the first driven roller and the second driven roller is provided with a packing strap guide mechanism along a peripheral direction of the drive roller. When the drive roller gets close to a right side of the packing machine, the second driven roller is positioned at a lower right side of the drive roller, and the first driven roller is positioned at an upper right side of the drive roller. When the drive roller gets close to a left side of the packing machine, the second driven roller is positioned at a lower left side of the drive roller, and the first driven roller is positioned at an upper left side of the drive roller.

The control mechanism includes a machine core spindle and a spindle motor. The machine core spindle is provided with a plurality of cams for controlling the ironing adhering and strap cutting mechanism and the ironing adhering sliding board mechanism, and a strap tightening cam for controlling the second driven roller to move. The spindle motor drives the machine core spindle to rotate by means of a decelerating mechanism.

The strap tightening cam controls the second driven roller by means of a swing system having a reset spring and a regulating spring.

The swing system includes a first swing arm which is provided with a roller matching with the strap tightening cam; the first swing arm is connected with a pull rod by means of a lower cardan connector, the pull rod is sleeved with the regulating spring regulated by an upper nut of the pull rod, the pull rod acts on an upper cardan connector by means of the regulating spring, the upper cardan connector is connected with a second swing arm, the reset spring is connected to the second swing arm, a fixed-distance structure is provided between the lower cardan connector and the upper cardan connector, and an eccentric shaft of the second driven roller is driven by the second swing arm to rotate.

The upper cardan connector is sleeved outside the pull rod, and the fixed-distance structure is a sleeve gasket sleeved outside the pull rod.

The machine core spindle is further provided with a first inductive cam and a second inductive cam, and the machine core is internally provided with a first inductor and a second inductor matching with each other; signal generated by match of the first inductive cam and the first inductor is configured to ensure a controller of the control mechanism to control an operation state of the spindle motor and the drive motor of the drive roller in a packing cycle, and signal generated by match of the second inductive cam and the second inductor is configured to ensure the controller of the control mechanism to control the spindle motor to drive the spindle to reset and to control the drive motor of the drive roller to rotate for strap feeding after a packing cycle is completed.

The decelerating mechanism includes a motor shaft gear, a first gear, a second gear and a machine core spindle gear, the motor shaft gear is engaged with the first gear, the first gear is coaxial with the second gear, the second gear is engaged with the machine core spindle gear, the motor shaft gear and the first gear constitute a speed reducing gear pair, and the second gear and the machine core spindle gear constitute a speed reducing gear pair.

The packing machine is provided with a machine core mounting rack, and the machine core spindle penetrates through the machine core mounting rack; both the spindle motor and the decelerating mechanism are positioned outside one side of the machine core mounting rack, and the decelerating mechanism is externally provided with a housing; the a plurality of cams for controlling the ironing adhering and strap cutting mechanism and the ironing adhering sliding board mechanism are positioned on the machine core spindle in the machine core mounting rack, and the strap tightening cam and inductive cams are arranged on the machine core spindle positioned outside one side of the machine core mounting rack.

The ironing adhering and strap cutting mechanism includes an ironing board arranged on the swing arm. The ironing adhering and strap cutting mechanism is further provided with a left cutter and a mounting column of the left cutter, a middle cutter and a mounting column of the middle cutter, a right cutter and a mounting column of the right cutter.

The left cutter is separated from the mounting column of the left cutter, and the left cutter may be detachably connected to a top of the mounting column of the left cutter; or/and the middle cutter is separated from the mounting column of the middle cutter, and the middle cutter may be detachably connected to a top of the mounting column of the middle cutter; or/and the right cutter is separated from the mounting column of the right cutter, and the right cutter may be detachably connected to a top of the mounting column of the right cutter.

When the left cutter is separated from the mounting column of the left cutter, the left cutter is connected to the mounting column of the left cutter from up to down by a screw; when the middle cutter is separated from the mounting column of the middle cutter, the middle cutter is connected to the mounting column of the middle cutter from up to down by the screw; when the right cutter is separated from the mounting column of the right cutter, the right cutter is connected to the mounting column of the right cutter from up to down by the screw.

When the middle cutter is separated from the mounting column of the middle cutter, a key slot positioning structure is provided between the middle cutter and the mounting column of the middle cutter; a length direction of the key slot is in parallel with a strap feeding and returning direction of a packing strap on the middle cutter.

When the right cutter is separated from the mounting column of the right cutter, a step positioning mechanism is provided between the right cutter and the mounting column of the right cutter, the step is a step in a left-right direction, and the step on the mounting column of the right cutter is high on the left side and low on the right side.

The mounting column is a guide circular column, a lateral surface of which is a cylindrical surface playing a guiding role.

The mounting column is internally provided with a pressure spring hole perforated downward, the pressure spring hole is internally provided with a pressure spring. The mounting column is further provided with a pressure spring plate and a roller, and the mounting column is provided with an elevating and guiding slot at both sides of a lower end of the guide circular column. The pressure spring plate is provided with a mounting lug bent downwards, and a shaft of the roller passes through the mounting lug and is connected to the elevating and guiding slot in a liftable and lowerable way. A mounting bracket is provided at both sides of a lower end of the mounting column. The elevating and guiding slot is disposed on the bracket. Both the pressure spring plate and the roller are arranged between the mounting brackets at both sides.

The machine core is disposed at one side where the ironing board is arranged, and a lateral dust-collecting fan is provided at an upper part of the machine core.

Due to adoption of the technical solution of the invention, the machine core of the invention has a simple structure, can enable movement of simultaneous strap returning and tightening. Even though packing straps themselves have different thicknesses and widths in different sections and batches, it is also possible to reduce excessive tensioning impact force applied to the articles strapped and the packing straps and ensure the tensioning force for each tensioning movement is consistent and stable, thus improving the packing quality; also, when the packing straps are tightened fully, the control device may obtain signal accurately in real time by relying on the current change of motors, and the machine core may accurately cut straps and complete ironing and adhering and the like, thereby reducing failure rate, and achieving good packing. Besides, strapping force, strap feeding length and temperature as well as ironing adhering delay may be regulated by means of a potentiometer.

DETAILED DESCRIPTION OF THE EMBODIMENTS

Figure 1:
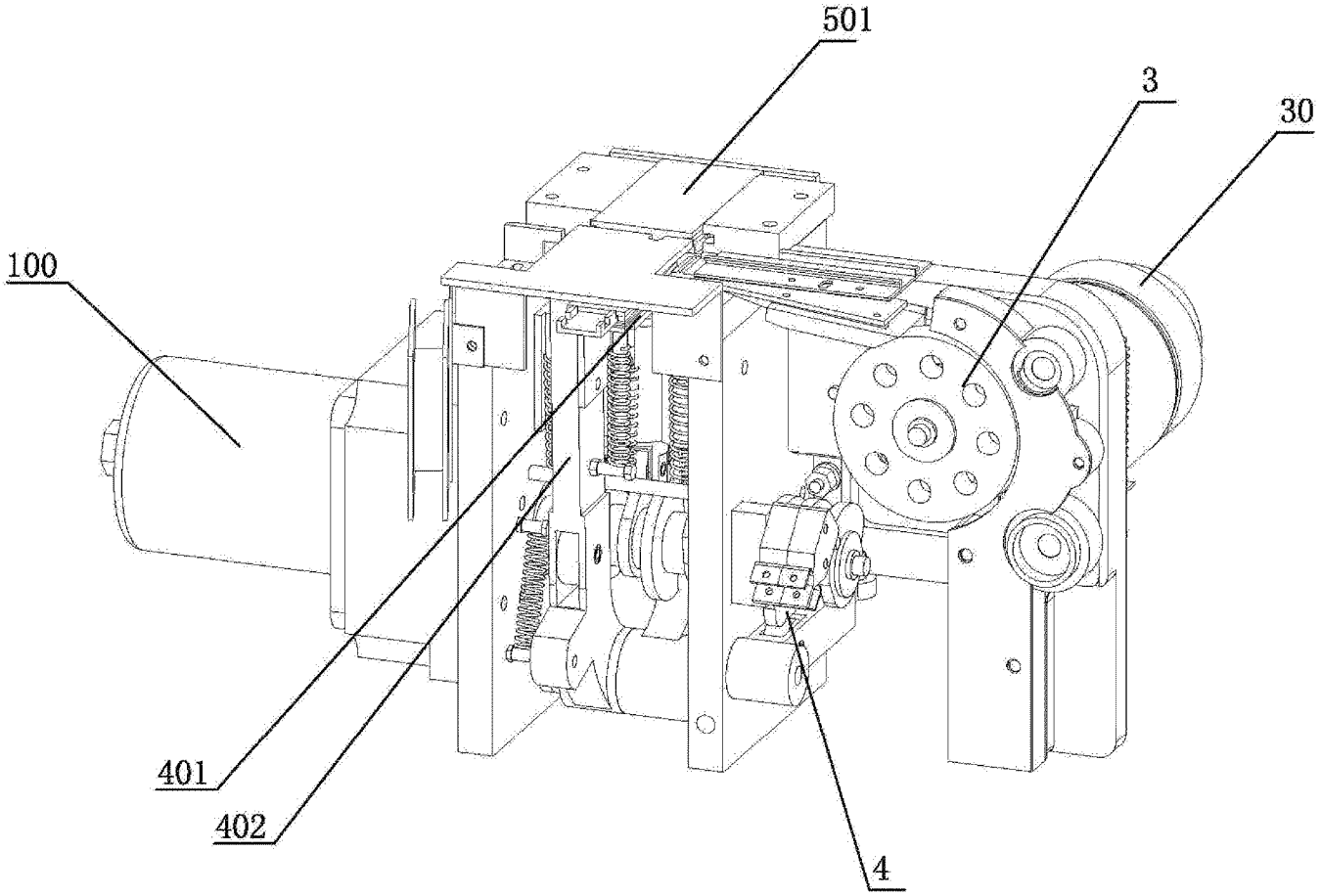
FIG. 1 is a three-dimensional schematic diagram of an embodiment according to the invention.
Figure 2:
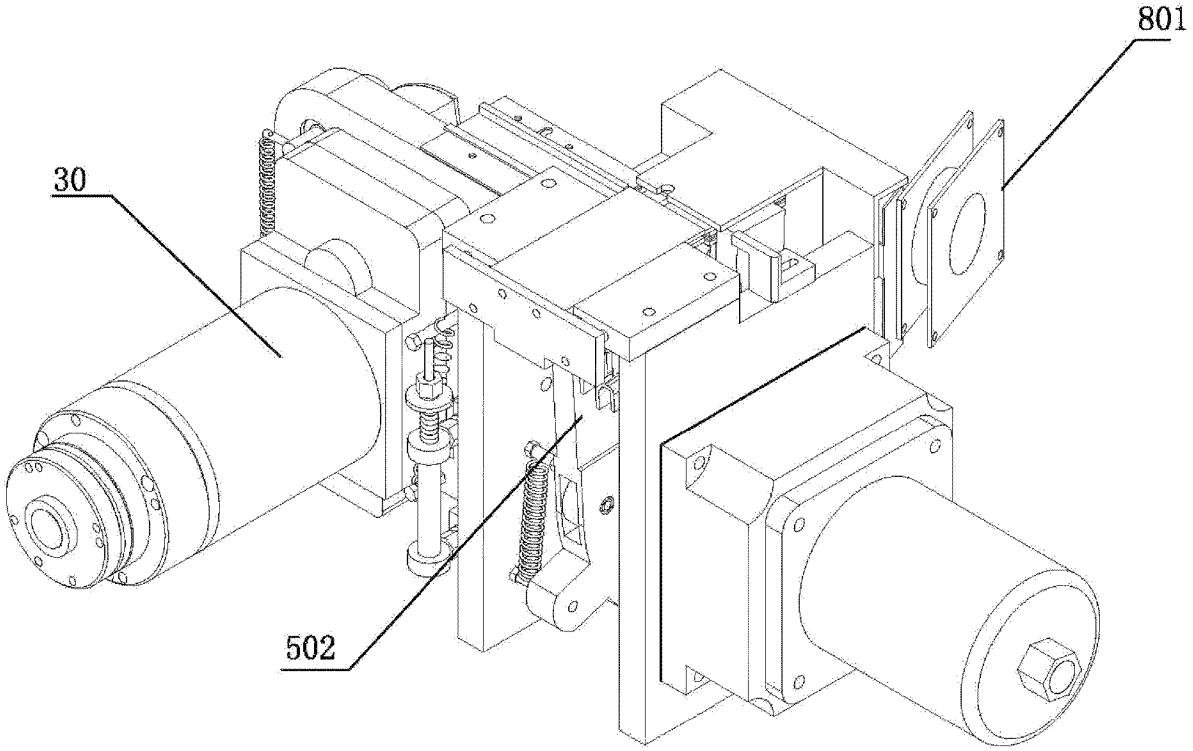
FIG. 2 is a three-dimensional schematic diagram of the embodiment according to the invention observed from another direction.
Figure 3:
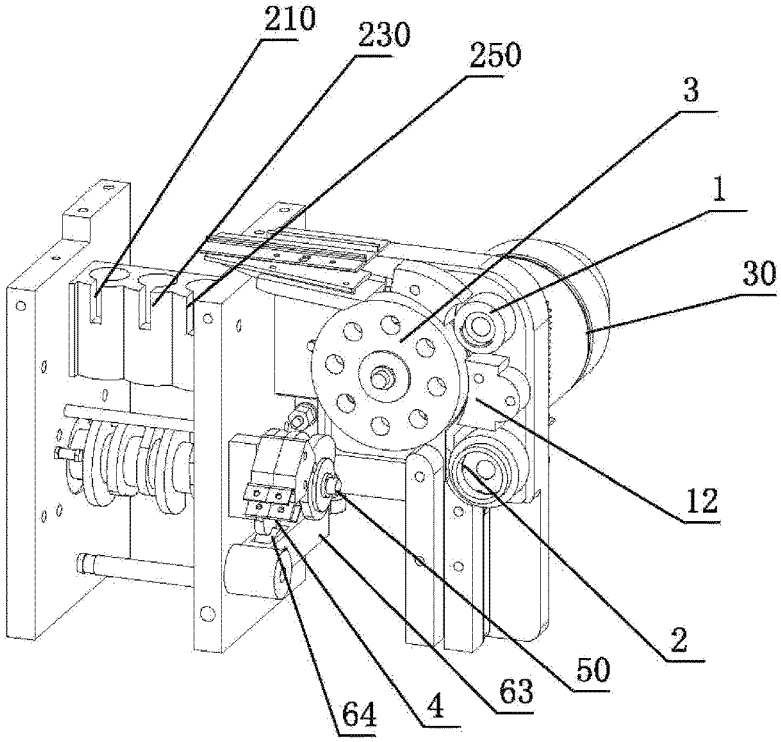
FIG. 3 is a schematic diagram of the embodiment of the belt feeding and retreating and belt tensioning device according to the invention observed from a direction.
Figure 4:
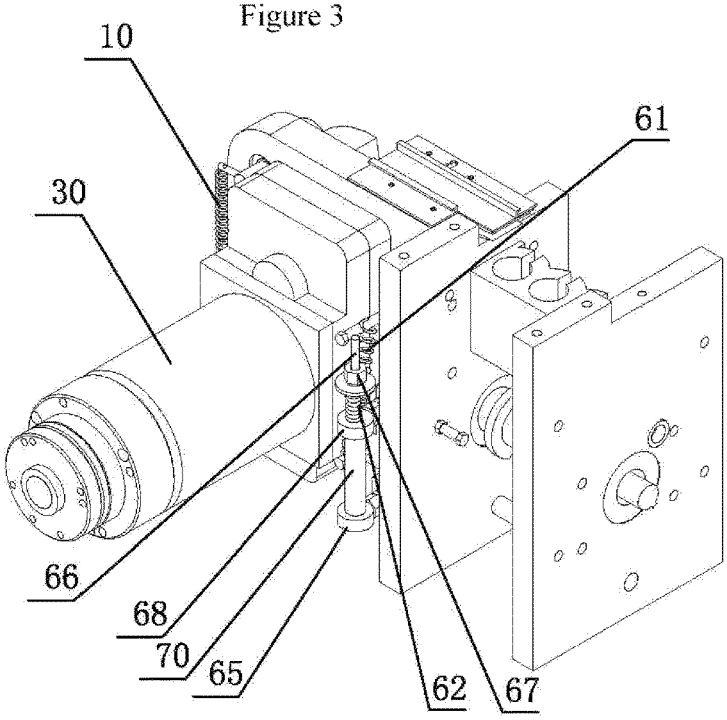
FIG. 4 is a schematic diagram of the embodiment of the belt feeding and retreating and belt tensioning device according to the invention observed from another direction.
Figure 5:
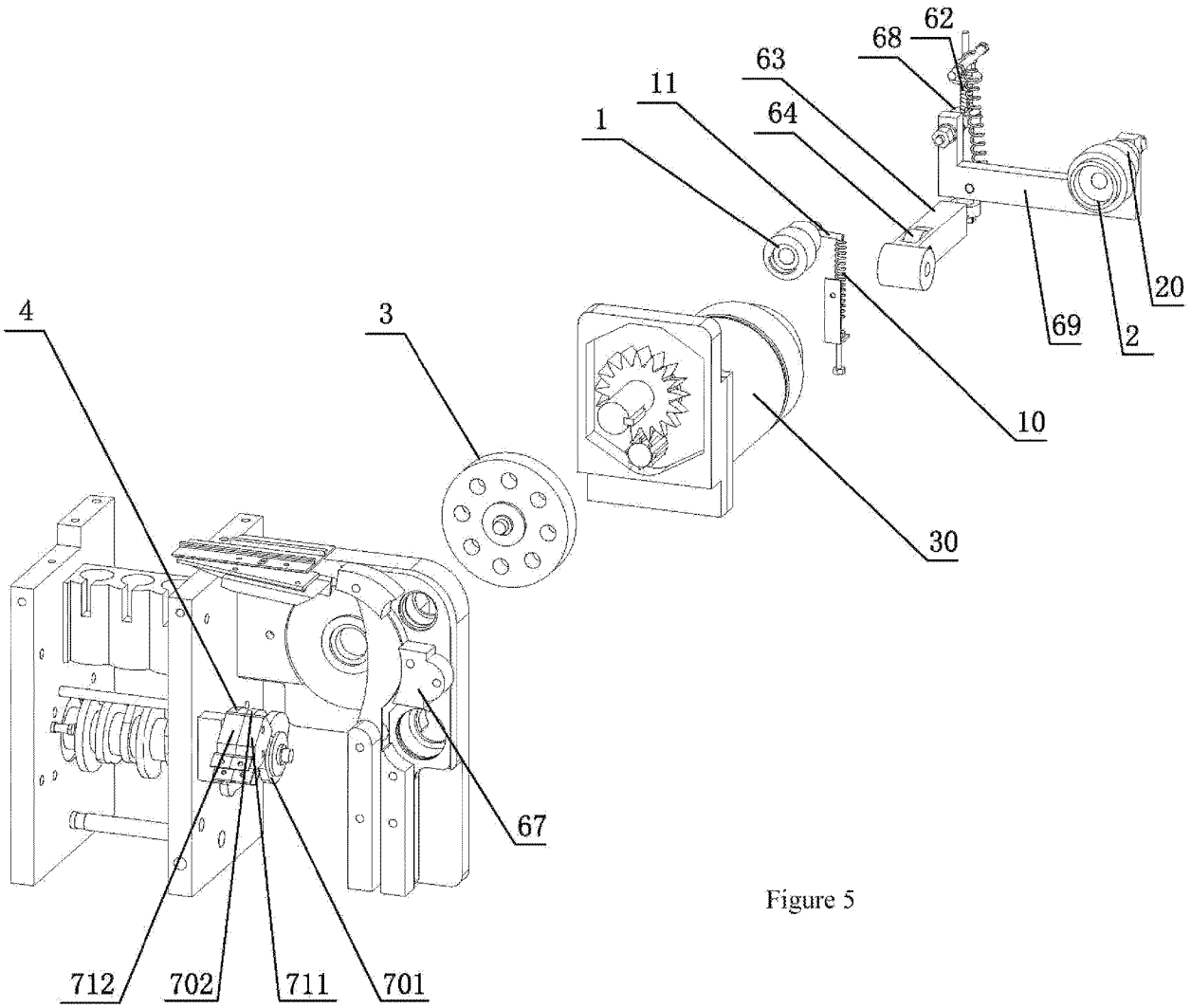
FIG. 5 is a structural explosive view of the embodiment of the belt feeding and retreating and belt tensioning device according to the invention.
Figure 6:
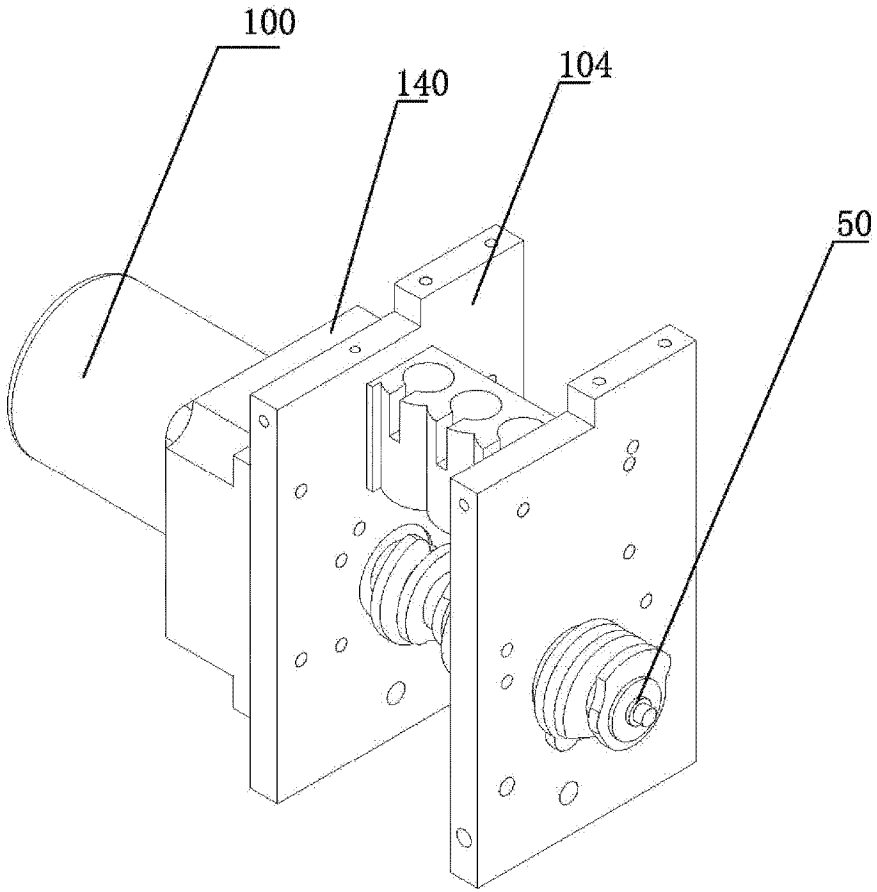
FIG. 6 is a schematic diagram of an embodiment of the decelerating mechanism according to the invention.
Figure 7:
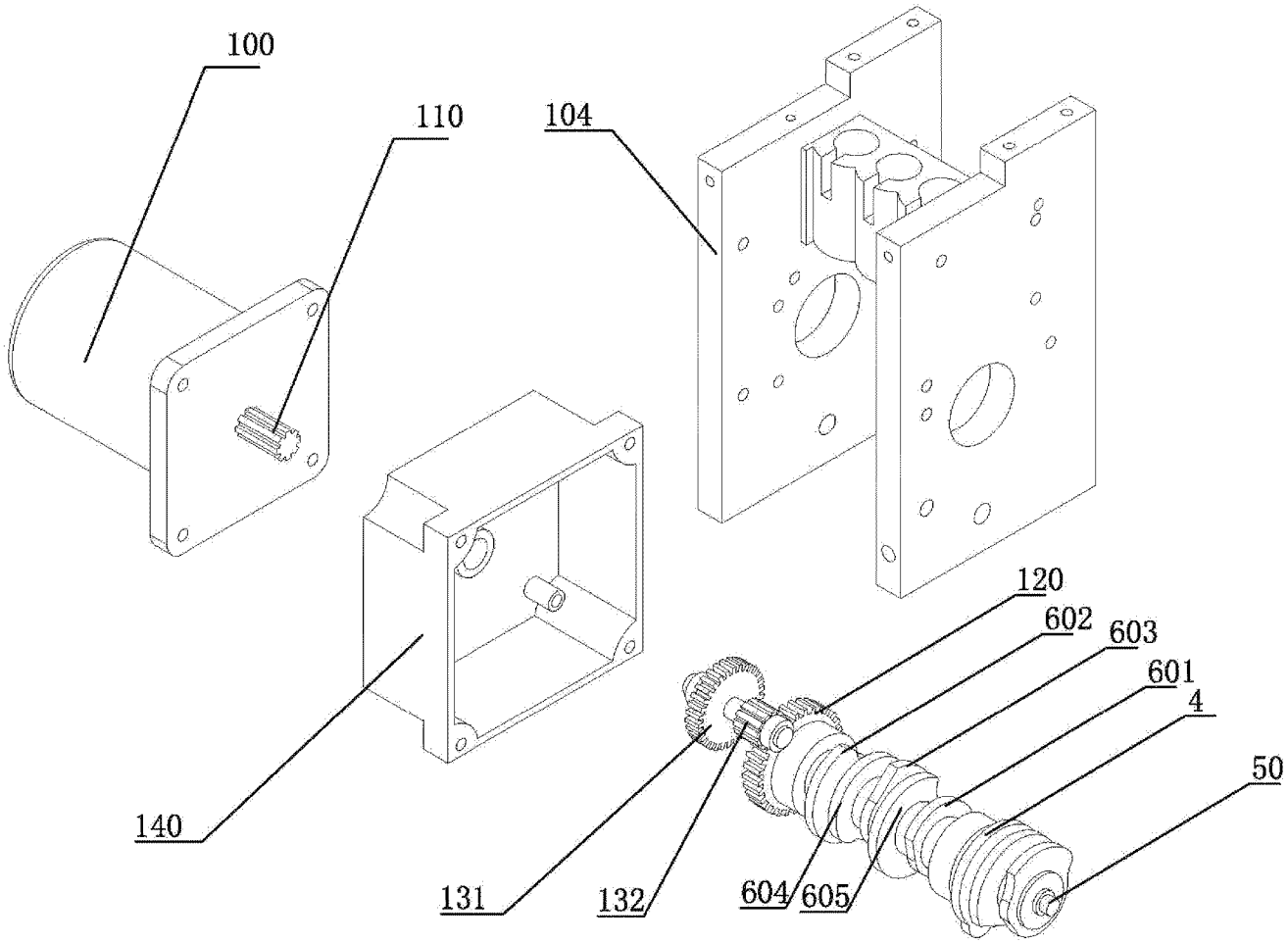
FIG. 7 is an explosive view of the embodiment as shown in FIG. 6.
Figure 8:
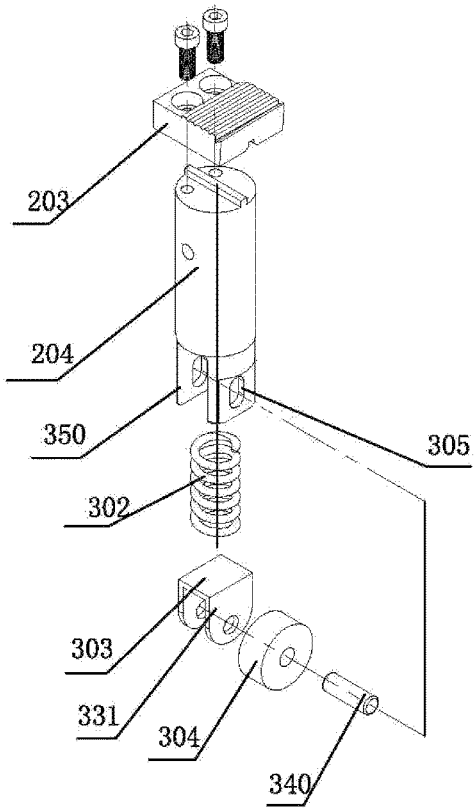
FIG. 8 is an explosive view of an internal structure of the strap cutting mechanism by taking the mounting column of the middle cutter as an example.
Figure 9:
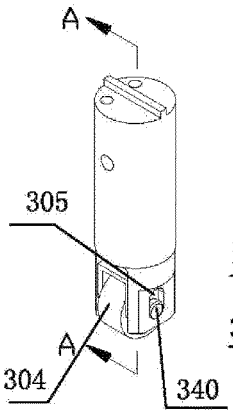
FIG. 9 is a schematic diagram of the structure as shown in FIG. 8 after assembly.
Figure 10:
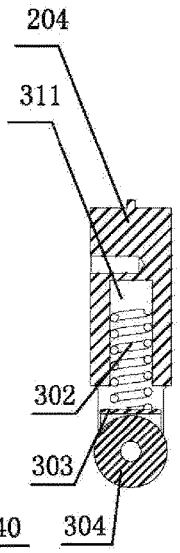
FIG. 10 is an A-A sectional view of FIG. 9.
Figure 11:
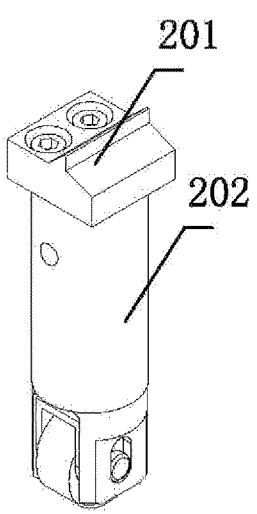
FIG. 11 is a schematic diagram of the invention in which the left cutter and the mounting column of the left cutter are assembled together.
Figure 12:
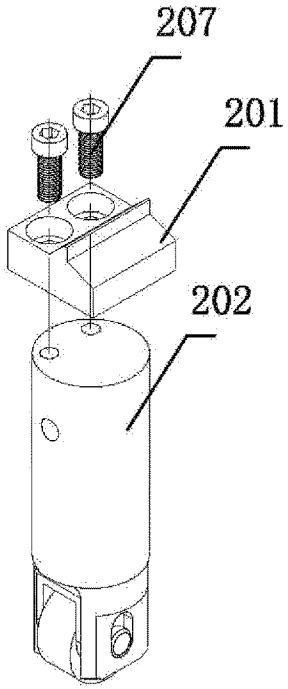
FIG. 12 is an explosive view of FIG. 11.
Figure 13:
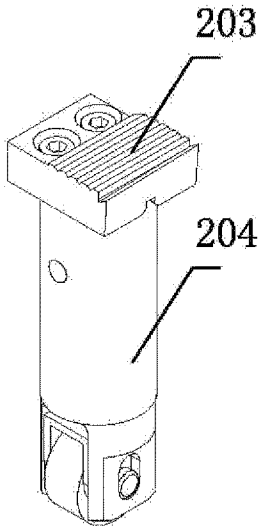
FIG. 13 is a schematic diagram of the invention in which the middle cutter and the mounting column of the middle cutter are assembled together.
Figure 14:
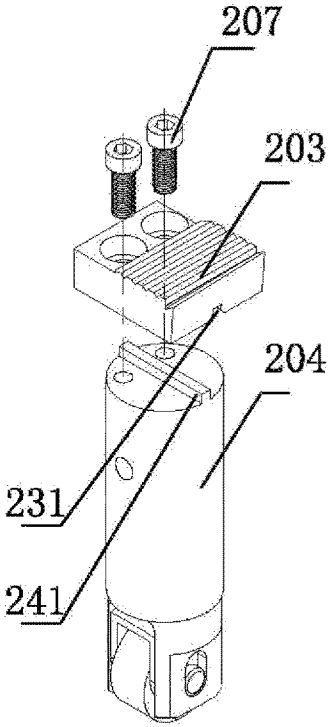
FIG. 14 is an explosive view of FIG. 13.
Figure 15:
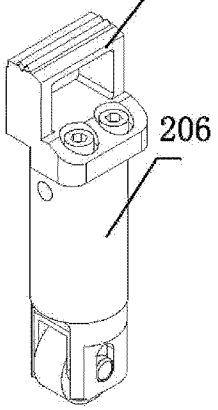
FIG. 15 is a schematic diagram of the invention in which the right cutter and the mounting column of the right cutter are assembled together.
Figure 16:
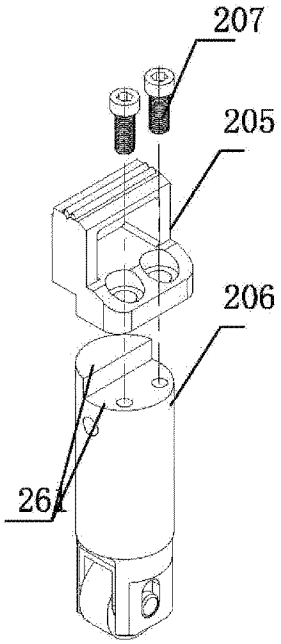
FIG. 16 is an explosive view of FIG. 15.
Figure 17:
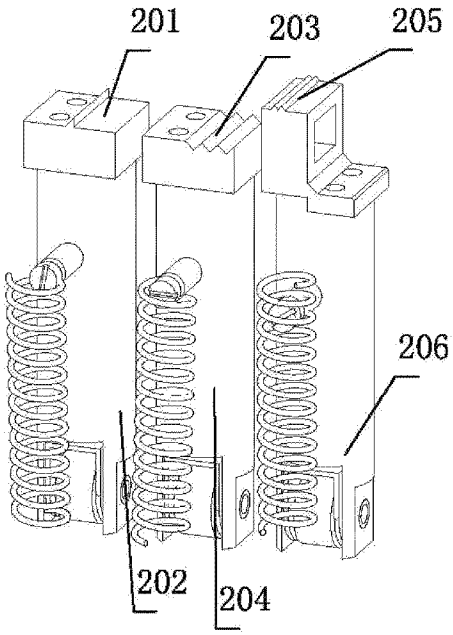
FIG. 17 is a schematic diagram when structures as shown in FIGS. 11, 13 and 15 are assembled together.

The invention includes a packing strap cutting mechanism, an ironing adhering mechanism, and a control mechanism. The control mechanism includes a machine core spindle and a spindle motor. The machine core spindle is provided with a plurality of cams for controlling the strap cutting mechanism and the ironing adhering mechanism. The machine core is further provided with a strap feeding and returning and strap tightening device. The strap feeding and returning and strap tightening device includes a drive roller 3, a first driven roller 1, and a second driven roller 2. According to the entry direction of a packing strap, the first driven roller 1 is located down-stream from the second driven roller 2. The first driven roller 1 and the second driven roller 2 are respectively arranged eccentrically. Driven by a spring 10, the first driven roller 1 is always in contact with the drive roller for feeding and returning the strap. The second driven roller 2 is a movable roller, and is controlled by the strap tightening cam 4 to move to a first matching state with the drive roller 3 and to move out of the first matching state with the drive roller 3. The first matching state is the state in which the second driven roller 2 and the drive roller 3 are in contact with and cooperating with one another for tightening the strap. The strap tightening cam 4 is arranged on the machine core spindle 50, and the spindle motor 100 drives the machine core spindle 50 to rotate by means of a decelerating mechanism. Figure reference number 30 stands for a drive motor of the drive roller, and the drive motor 30 drives the drive roller to rotate by means of the decelerating mechanism.

The spring 10 may drive the first driven roller 1 to always lean against the drive roller 3 by means of a connecting mechanism. For example, a shaft of the first driven roller 1 is connected with the spring 10 by means of a connecting rod 11.

Between the first driven roller 1 and the second driven roller 2 is provided with a packing strap guide mechanism 12 along a peripheral direction of the drive roller 3, for example, a guide bar, a guide block or the like. As shown in Figs., when the drive roller 3 gets close to a right side of the packing machine, the second driven roller 2 is positioned at a lower right side of the drive roller 3, and the first driven roller 1 is positioned at an upper right side of the drive roller 3, and the second driven roller 2 is just positioned at a location from which the packing strap threads out so that an area of the packing strap wrapping around the drive roller 3 is maximized, and the strap fits perfectly by friction force, thus improving the packing quality and reducing the packing fault.

The cam 4 controls movements of the second driven roller 2 leaning against the drive roller 3 and getting away from the drive roller 3 by means of a set of swing system having a reset spring 61 and a regulating spring 62.

The swing system includes a first swing arm 63 which is provided with a roller 64 matching with the strap tightening cam; the first swing arm 63 is connected with a pull rod 66 by means of a lower cardan connector 65, the pull rod 66 is sleeved with the regulating spring 62 regulated by an upper nut 67 of the pull rod, the pull rod 66 acts on an upper cardan connector 68 by means of the regulating spring 62. The regulating spring 62 may play a buffer movement and regulate strapping force of the packing strap.

The upper cardan connector 68 is connected with a second swing arm 69, the reset spring 61 is connected to the second swing arm 69, a fixed-distance structure is provided between the lower cardan connector 65 and the upper cardan connector 68, and an eccentric shaft of the second driven roller is driven by the second swing arm 69 to rotate. The upper cardan connector 68 is sleeved outside the pull rod 66, and the fixed-distance structure is a sleeve gasket 70 sleeved outside the pull rod 66. Figure reference number 20 stands for a bearing of the eccentric shaft of the second driven roller, which is fixed to a machine core frame and serves as a rotating fulcrum of the second swing arm.

When it is switched on packing, the first driven roller always leans against the drive roller for strap feeding and returning. When it is switched on to return the strap, the first driven roller plays a role in strap returning, and the second driven roller is controlled by the cam 4 and also leans against the drive roller and plays a role in simultaneous strap returning and tightening.

The ironing adhering and strap cutting mechanism includes an ironing board 401 arranged on the swing arm 402. The ironing adhering and strap cutting mechanism is further provided with a left cutter 201 and a mounting column 202 of the left cutter, a middle cutter 203 and a mounting column 204 of the middle cutter, a right cutter 205 and a mounting column 206 of the right cutter.

In the invention, among the following three structures, it is possible to set only one, or any two or all the three structures. In this way, cutters and mounting columns may be processed respectively and manufactured easily. Furthermore, it is more convenient for replacing, and only wear parts need replacing instead of integrally replacing the mounting seats and cutter heads, thus reducing waste.

1. The left cutter is separated from the mounting column of the left cutter, and the left cutter may be detachably connected to a top of the mounting column of the left cutter;

2. the middle cutter is separated from the mounting column of the middle cutter, and the middle cutter may be detachably connected to a top of the mounting column of the middle cutter;

3. the right cutter is separated from the mounting column of the right cutter, and the right cutter may be detachably connected to a top of the mounting column of the right cutter.

When the left cutter 201 is separated from the mounting column 202 of the left cutter, the left cutter is connected to the mounting column of the left cutter from up to down by a screw 207; when the middle cutter is separated from the mounting column of the middle cutter, the middle cutter is connected to the mounting column of the middle cutter from up to down by the screw 207; when the right cutter is separated from the mounting column of the right cutter, the right cutter is connected to the mounting column of the right cutter from up to down by the screw 207. In this way, the left cutter, the middle cutter and the right cutter may be conveniently disassembled at any time.

When the middle cutter 203 is separated from the mounting column 204 of the middle cutter, a key slot positioning structure is provided between the middle cutter 203 and the mounting column 204 of the middle cutter. Further, a length direction of the key slot is the same as a strap feeding and returning direction of a packing strap on the middle cutter. Figure reference number 241 stands for the key on the top of the mounting column of the middle cutter, and figure reference number 231 stands for the slot on the bottom surface of the middle cutter. When the right cutter 205 is separated from the mounting column 206 of the right cutter, a step positioning mechanism is provided between the right cutter 205 and the mounting column 206 of the right cutter, further, the step is a step in a left-right direction, and the step 261 on the mounting column of the right cutter is high on the left side and low on the right side. By adopting the above structure, working stability and strap cutting quality of the middle cutter and the right cutter may be improved, and operational convenience may be improved when the middle cutter and the right cutter are taken down or fit on.

As shown in Figs., the mounting column of the left cutter, the mounting column of the middle cutter and the mounting column of the right cutter are guide circular columns, side surfaces of the guide circular columns are cylindrical surfaces playing a guide role, and match with guide holes of the mounting column 210 of the left cutter, the mounting column 230 of the middle cutter and the mounting column 250 of the right cutter for ascending, descending or guiding. Operational stability and strap cutting quality of the strap cutting mechanism may be further improved.

The mounting column of the left cutter, the mounting column of the middle cutter and the mounting column of the right cutter are the same in internal structure. The internal structure is further described by taking the mounting column of the middle cutter as an example.

The guide circular column is internally provided with a pressure spring hole 311 perforated downward, the pressure spring hole 311 is internally provided with a pressure spring 302. The guide circular column is further provided with a pressure spring plate 303 and a roller 304, and the guide circular column is provided with an elevating and guiding slot 305 at both sides of a lower end of the guide circular column. The pressure spring plate 303 is provided with a mounting lug 331 bent downwards, and a shaft 340 of the roller passes through the mounting lug and is connected to the elevating and guiding slot 305 in a liftable and lowerable way. The pressure spring contacts with the pressure spring plate. A bearing roller may be used as the roller.

A mounting bracket 350 is provided at both sides of the lower end of the guide circular column. The slot 305 is disposed on the mounting bracket. Both the pressure spring plate and the roller are arranged between the mounting brackets at both sides.

The mounting column of the left cutter, the mounting column of the middle cutter and the mounting column of the right cutter are respectively controlled by a left cutter cam 602, a middle cutter cam 603 and a right cutter cam 601 for ascending or descending.

By adopting the above structure, it is not only to avoid a matching structure between the pressure spring hole and a slide bar in a previous spring seat mechanism, to reduce the manufacturing difficulty, to prolong the service life, but also to ensure a peripheral surface of the guide circular column to guide and match with a mounting hole on a machine core bracket, and to further improve operational stability of the spring seat mechanism.

The machine core is disposed at one side where an ironing board 401 is arranged, and a lateral dust-collecting fan 801 is provided at an upper part of the machine core so as to collect smoke and dust inside the machine core from the most appropriate position and angle.

Figure 19:
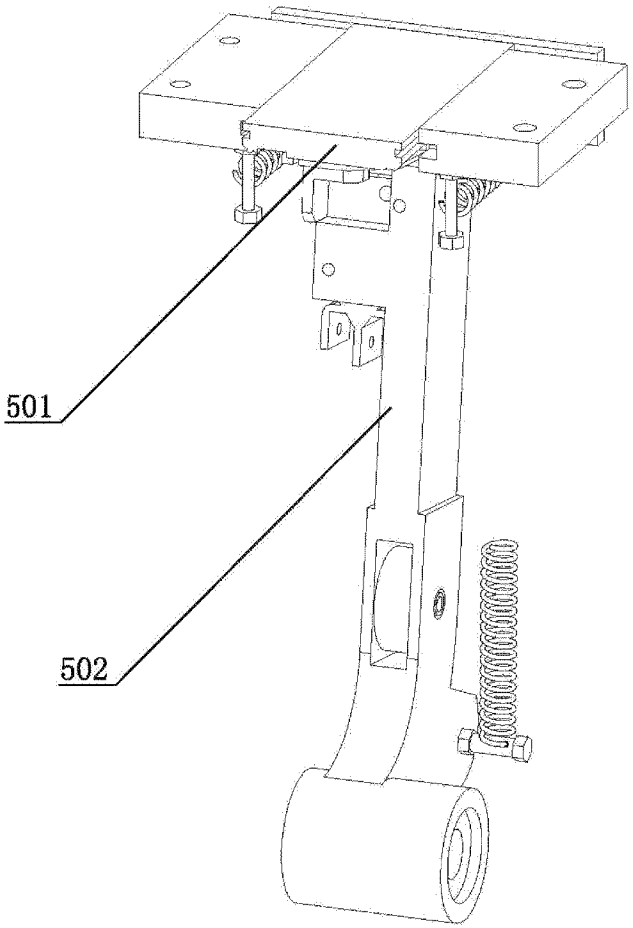
FIG. 19 is a schematic diagram when the ironing adhering sliding board and swing arms thereof are assembled together.
Figure 18:
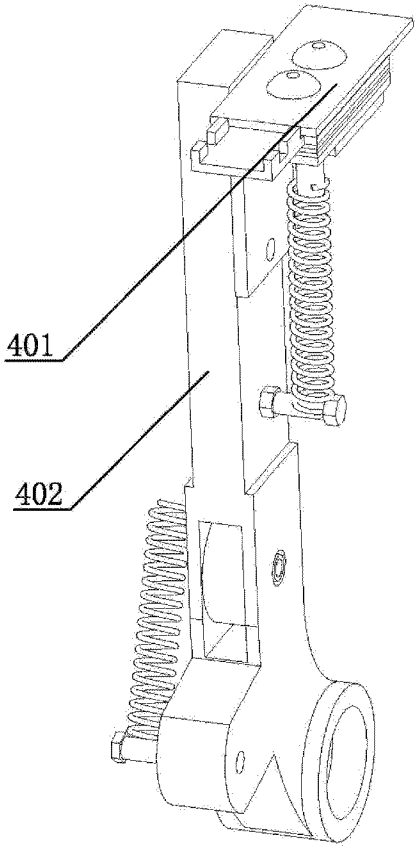
FIG. 18 is a schematic diagram when the ironing board and swing arms thereof are assembled together.

As shown in FIG. 19, figure reference number 501 stands for the ironing adhering sliding board in the machine core, figure reference number 502 stands for a swing arm. The ironing adhering sliding board 501 is arranged on the swing arm 502, and swing of the swing arm (i.e., movement of the ironing adhering sliding board) is controlled by a sliding board cam 605.

In the present embodiment, the machine core spindle is further provided with a first inductive cam 701 and a second inductive cam 702, and the machine core is internally provided with a first inductor 711 and a second inductor 712 matching with each other; signal generated by match of the first inductive cam and the first inductor is configured to ensure a controller of the control mechanism to control an operation state of the spindle motor and the drive motor of the drive roller in a packing cycle, and signal generated by match of the second inductive cam and the second inductor is configured to ensure the controller of the control mechanism to control the spindle motor to drive the spindle to reset and to control the drive motor of the drive roller to rotate for strap feeding after a packing cycle is completed. The controller may be a controller having calculation function.

The decelerating mechanism includes a motor shaft gear 110, a first gear 131, a second gear 132 and a machine core spindle gear 120, the motor shaft gear 110 is engaged with the first gear 131, the first gear 131 is coaxial with the second gear 132, the second gear 132 is engaged with the machine core spindle gear 120, the motor shaft gear 110 and the first gear 131 constitute a speed reducing gear pair, and the second gear 132 and the machine core spindle gear 120 constitute a speed reducing gear pair.

As shown in Figs., the packing machine is provided with a machine core mounting rack 104, and the machine core spindle 50 penetrates through the machine core mounting rack 104; both the spindle motor 100 and the decelerating mechanism are positioned outside one side of the machine core mounting rack 104, and the decelerating mechanism is externally provided with a housing 140; a plurality of cams 601, 602, 603, 604 and 605 for controlling the ironing adhering and strap cutting mechanism and the ironing adhering sliding board mechanism are positioned on the machine core spindle in the machine core mounting rack, and the strap tightening cam 4, the first inductive cam 701 and the second inductive cam 702 are arranged on the machine core spindle positioned outside one side of the machine core mounting rack. In this way, the packing machine is convenient to install, the volume of the machine core is reduced, and the operational stability of the machine core spindle 50 is improved.

In the present embodiment, the control mechanism controls movement of mechanical motion mechanisms in the machine core by way of cams. It is also possible to adopt other control modes as long as they can control these mechanical motion mechanisms to work.

The following is the working process of the machine core:

- a strap is inserted manually to switch on the spindle motor 100 is turned on;
- under the control of the right cutter cam 601, the right cutter withstands a strap head at the sliding board 501;
- the swing arm 502 is controlled by the sliding board cam 605 to retreat;
- under the control of the strap tightening cam 4, the second driven roller 2 and the drive roller 3 are at the first matching state; the first inductive cam 701 inducts the inductor 711, a strap returning switch is switched on, the spindle motor 100 stops, and the drive motor 30 is switched on to contrarotate;
- after the strap retreats onto an article strapped, when a detected current value of the drive motor 30 is greater than a setting current value, the spindle motor 100 is switched on once again;
- under the control of the left cutter cam 602, the left cutter 201 withstands the strap at the sliding board 501;
- the first inductive cam 701 switches the inductor 711 off, and the drive motor 30 stops;
- the ironing board cam 604 controls movement of the swing arm 402, and the ironing board 401 is inserted between two layers of straps;
- under the control of the middle cutter cam 603, the middle cutter 203 pushes up, cuts the strap, and withstands the strap and the ironing board 401 until the upper and the lower layers of the strap are melted on surface;
- the first inductive cam 701 inducts the inductor 711 once again, the drive motor 30 is switched on to contrarotate and the strap head is retreated somewhat;
- under the control of the middle cutter cam 603, the middle cutter 203 descends, the ironing board cam 604 controls movement of the swing arm 402, and the ironing board 401 retreats out;
- under the control of the middle cutter cam 603, the middle cutter 203 pushes up once again, withstands tightly the strap at the sliding board 501 so that the strap is adhered tightly;
- the first inductive cam 701 switches the inductor 711 off once again; the spindle motor stops, and ironing adhering delay is switched on; the spindle motor is switched on once again after the delay is over;
- under the control of the left cutter cam, the middle cutter cam and the right cutter cam, the left cutter, the middle cutter and the right cutter respectively descend;

the swing arm 502 is controlled by the sliding board cam 605 to retreat again to drive the sliding board to retreat to eject the strap out;

the swing arm 502 is controlled by the sliding board cam 605 to come back in situ, and the sliding board comes back in situ;

the second inductive cam 702 inducts the inductor 712, and an in-situ switch is switched on; the spindle motor stops and is instantaneously braked; mechanisms of the machine core come back in situ to get ready for a next working cycle; the drive motor 30 is switched on to rotate to feed the strap, in this way a working cycle is completed.

The invention claimed is:

1. A machine core of a packing machine, comprising a packing strap ironing adhering and strap cutting mechanism, an ironing adhering sliding board mechanism, and a control mechanism, wherein the machine core is further provided with a strap feeding and returning and strap tightening device, the strap feeding and returning and strap tightening device comprises a drive roller, a first driven roller, and a second driven roller; according to an entry direction of a packing strap, the first driven roller is located down-stream from the second driven roller; the first driven roller and the second driven roller are respectively arranged eccentrically; the first driven roller and the drive roller are always in contact with one another and cooperate for feeding and returning the strap; the second driven roller is a movable roller, and is controlled by the control mechanism to move to a first matching state with the drive roller and to move out of the first matching state with the drive roller; the first matching state is the state in which the second driven roller and the drive roller are in contact with and cooperating with one another for tightening the strap;

wherein the control mechanism comprises a machine core spindle and a spindle motor, the machine core spindle is provided with a plurality of cams for controlling the ironing adhering and strap cutting mechanism and the ironing adhering sliding board mechanism, and a strap tightening cam for controlling the second driven roller to move, and the spindle motor drives the machine core spindle to rotate by means of a decelerating mechanism;

wherein the strap tightening cam controls the second driven roller by means of a swing system having a reset spring and a regulating spring;

wherein the swing system comprises a first swing arm which is provided with a roller matching with the strap tightening cam; the first swing arm is connected with a pull rod by means of a lower cardan connector, the pull rod is sleeved with the regulating spring regulated by an upper nut of the pull rod, the pull rod acts on an upper cardan connector by means of the regulating spring, the upper cardan connector is connected with a second swing arm, the reset spring is connected to the second swing arm, a fixed-distance structure is provided between the lower cardan connector and the upper cardan connector, and an eccentric shaft of the second driven roller is driven by the second swing arm to rotate.

2. The machine core of the packing machine according to claim 1, wherein the upper cardan connector is sleeved outside the pull rod, and the fixed-distance structure is a sleeve gasket sleeved outside the pull rod.

3. The machine core of the packing machine according to claim 1, wherein a packing strap guide mechanism is provided between the first driven roller and the second driven roller along a peripheral direction of the drive roller; when the drive roller gets close to a right side of the packing machine, the second driven roller is positioned at a lower right side of the drive roller, and the first driven roller is positioned at an upper right side of the drive roller; when the drive roller gets close to a left side of the packing machine, the second driven roller is positioned at a lower left side of the drive roller, and the first driven roller is positioned at an upper left side of the drive roller.

4. A machine core of the packing machine, comprising a packing strap ironing adhering and strap cutting mechanism, an ironing adhering sliding board mechanism, and a control mechanism, wherein the machine core is further provided with a strap feeding and returning and strap tightening device, the strap feeding and returning and strap tightening device comprises a drive roller, a first driven roller, and a second driven roller; according to an entry direction of a packing strap, the first driven roller is located down-stream from the second driven roller; the first driven roller and the second driven roller are respectively arranged eccentrically; the first driven roller and the drive roller are always in contact with one another and cooperate for feeding and returning the strap; the second driven roller is a movable roller, and is controlled by the control mechanism to move to a first matching state with the drive roller and to move out of the first matching state with the drive roller; the first matching state is the state in which the second driven roller and the drive roller are in contact with and cooperating with one another for tightening the strap;

wherein the control mechanism comprises a machine core spindle and a spindle motor, the machine core spindle is provided with a plurality of cams for controlling the ironing adhering and strap cutting mechanism and the ironing adhering sliding board mechanism, and a strap tightening cam for controlling the second driven roller to move, and the spindle motor drives the machine core spindle to rotate by means of a decelerating mechanism;

wherein the machine core spindle is further provided with a first inductive cam and a second inductive cam, and the machine core is internally provided with a first inductor and a second inductor matching with each other; signal generated by match of the first inductive cam and the first inductor is configured to ensure a controller of the control mechanism to control an operation state of the spindle motor and the drive motor of the drive roller in a packing cycle, and signal generated by match of the second inductive cam and the second inductor is configured to ensure the controller of the control mechanism to control the spindle motor to drive the spindle to reset and to control the drive motor of the drive roller to rotate for strap feeding after a packing cycle is completed.

5. A machine core of the packing machine, comprising a packing strap ironing adhering and strap cutting mechanism, an ironing adhering sliding board mechanism, and a control mechanism, wherein the machine core is further provided with a strap feeding and returning and strap tightening device, the strap feeding and returning and strap tightening device comprises a drive roller, a first driven roller, and a second driven roller; according to an entry direction of a packing strap, the first driven roller is located down-stream from the second driven roller; the first driven roller and the second driven roller are respectively arranged eccentrically; the first driven roller and the drive roller are always in contact with one another and cooperate for feeding and returning the strap; the second driven roller is a movable roller, and is controlled by the control mechanism to move to a first matching state with the drive roller and to move out of the first matching state with the drive roller; the first matching state is the state in which the second driven roller and the drive roller are in contact with and cooperating with one another for tightening the strap;

wherein the control mechanism comprises a machine core spindle and a spindle motor, the machine core spindle is provided with a plurality of cams for controlling the ironing adhering and strap cutting mechanism and the ironing adhering sliding board mechanism, and a strap tightening cam for controlling the second driven roller to move, and the spindle motor drives the machine core spindle to rotate by means of a decelerating mechanism;

wherein the decelerating mechanism comprises a motor shaft gear, a first gear, a second gear and a machine core spindle gear, the motor shaft gear is engaged with the first gear, the first gear is coaxial with the second gear, the second gear is engaged with the machine core spindle gear, the motor shaft gear and the first gear constitute a speed reducing gear pair, and the second gear and the machine core spindle gear constitute a speed reducing gear pair.

6. The machine core of the packing machine according to claim 4, wherein the packing machine is provided with a machine core mounting rack, and the machine core spindle penetrates through the machine core mounting rack; both the spindle motor and the decelerating mechanism are positioned outside one side of the machine core mounting rack, and the decelerating mechanism is externally provided with a housing; the plurality of cams for controlling the ironing adhering and strap cutting mechanism and the ironing adhering sliding board mechanism are positioned on the machine core spindle in the machine core mounting rack, and the strap tightening cam and inductive cams are arranged on the machine core spindle positioned outside one side of the machine core mounting rack.

7. The machine core of the packing machine according to claim 1, wherein the machine core is positioned at one side where an ironing board is arranged, and a lateral dust-collecting fan is provided at an upper part of the machine core.

* * * * *